US010597247B2

(12) United States Patent
Eiyama et al.

(10) Patent No.: US 10,597,247 B2
(45) Date of Patent: Mar. 24, 2020

(54) PRINTING APPARATUS

(71) Applicant: CANON KABUSHIKI KAISHA, Tokyo (JP)

(72) Inventors: Masato Eiyama, Yokohama (JP); Masashi Kamada, Kawasaki (JP); Yuki Igarashi, Tokyo (JP); Masashi Negishi, Kawasaki (JP); Ryoya Shinjo, Kawasaki (JP); Ryo Kobayashi, Kawasaki (JP); Tomohiro Suzuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/912,869

(22) Filed: Mar. 6, 2018

(65) Prior Publication Data

US 2018/0257892 A1 Sep. 13, 2018

(30) Foreign Application Priority Data

Mar. 10, 2017 (JP) ..... 2017-046416

(51) Int. Cl.

| | |
|---|---|
| ***B41J 11/00*** | (2006.01) |
| ***B65H 23/038*** | (2006.01) |
| ***B65H 20/02*** | (2006.01) |
| ***B41J 15/04*** | (2006.01) |
| ***B65H 16/10*** | (2006.01) |

(Continued)

(52) U.S. Cl.

CPC ..... *B65H 23/038* (2013.01); *B41J 11/006* (2013.01); *B41J 11/0095* (2013.01); *B41J 11/70* (2013.01); *B41J 15/04* (2013.01); *B41J 15/18* (2013.01); *B65H 16/106* (2013.01); *B65H 20/02* (2013.01); *B65H 2403/942* (2013.01); *B65H 2801/03* (2013.01)

(58) Field of Classification Search

CPC ..... B41J 13/0009
USPC ..... 347/16
See application file for complete search history.

(56) References Cited

U.S. PATENT DOCUMENTS

| | | | |
|---|---|---|---|
| 9,334,137 | B2 | 5/2016 | Igarashi et al. |
| 9,539,831 | B2 | 1/2017 | Tanami et al. |
| 9,579,907 | B2 | 2/2017 | Shinjo et al. |

(Continued)

FOREIGN PATENT DOCUMENTS

| | | | |
|---|---|---|---|
| JP | 10-157232 | A | 6/1998 |
| JP | 10-329964 | A | 12/1998 |

(Continued)

OTHER PUBLICATIONS

U.S. Appl. No. 15/902,509, Takahiro Daikoku Masashi Kamada Masato Eiyama Yuki Igarashi Masashi Negishi Ryoya Shinjo Ryo Kobayashi Tomohiro Suzuki, filed Feb. 22, 2018.

(Continued)

*Primary Examiner* — Lam S Nguyen
(74) *Attorney, Agent, or Firm* — Venable LLP

(57) ABSTRACT

Automatic sheet feeding of an installed roll is performed more reliably. To this end, a leading end of a sheet is detected on the basis of a change in an output value of a sensor while causing a roll to rotate in a winding direction using a sensor capable of detecting a distance to the sheet separated from the roll. After the detection, the roll is caused to rotate in a feeding direction, and a feeding state of the sheet is determined on the basis of a change in the output value of the sensor.

7 Claims, 12 Drawing Sheets

(51) Int. Cl.
*B41J 11/70* (2006.01)
*B41J 15/18* (2006.01)

(56) References Cited

U.S. PATENT DOCUMENTS

| | | | | |
|---|---|---|---|---|
| 9,592,683 | B2 | 3/2017 | Kobayashi et al. | |
| 2013/0141487 | A1* | 6/2013 | Abe | B41J 11/00 347/16 |
| 2015/0328906 | A1 | 11/2015 | Sumioka et al. | |
| 2016/0136981 | A1 | 5/2016 | Suzuki et al. | |
| 2016/0207333 | A1 | 7/2016 | Igarashi et al. | |
| 2017/0120636 | A1 | 5/2017 | Kobayashi et al. | |

FOREIGN PATENT DOCUMENTS

| | | | |
|---|---|---|---|
| JP | 2004-025663 | A | 1/2004 |
| JP | 2004-074710 | A | 3/2004 |
| JP | 2010-228834 | A | 10/2010 |
| JP | 2011-037557 | A | 2/2011 |
| JP | 2012-180139 | A | 9/2012 |
| JP | 2013-035616 | A | 2/2013 |
| JP | 2013-184765 | A | 9/2013 |
| JP | 2016-104665 | A | 6/2016 |

OTHER PUBLICATIONS

U.S. Appl. No. 15/903,493, Shuichi Masuda Masashi Kamada Masato Eiyama Yuki Igarashi Masashi Negishi Ryoya Shinjo Ryo Kobayashi Tomohiro Suzuki, filed Feb. 23, 2018.
U.S. Appl. No. 15/906,146, Masato Eiyama Yuki Igarashi Masashi Kamada Masashi Negishi Ryoya Shinjo Ryo Kobayashi Tomohiro Suzuki Tsutomu Obata, filed Feb. 27, 2018.
U.S. Appl. No. 15/910,489, Tomohiro Suzuki Masashi Kamada Masato Eiyama Yuki Igarashi Masashi Negishi Ryoya Shinjo Ryo Kobayashi, filed Mar. 2, 2018.
U.S. Appl. No. 15/912,592, Midori Yasuda Yuki Kamio Masashi Kamada Masato Eiyama Yuki Igarashi Masashi Negishi Ryoya Shinjo Ryo Kobayashi Tomohiro Suzuki, filed Mar. 6, 2018.
Office Action dated Jan. 28, 2020, in Japanese Patent Application No. 2017-046416.

* cited by examiner

PRINTING APPARATUS

BACKGROUND OF THE INVENTION

Field of the Invention

The present invention relates to a printing apparatus that pulls a sheet out of a roll on which a continuous sheet is wound and supplies the sheet.

Description of the Related Art

A printing apparatus capable of detecting a sheet leading end of an installed roll and automatically feeding the sheet is disclosed in Japanese Patent Laid-Open No. 2011-37557. In this apparatus, the sheet leading end is detected through an optical sensor while causing the roll to rotate in a winding direction opposite to a supply direction, and if the detection is completed, the roll is rotated in the supply direction to peel the sheet from the roll and feed the separated sheet to the apparatus.

However, in the configuration of Japanese Patent Laid-Open No. 2011-37557, even when the sheet leading end of the roll can be normally detected, the leading end of the sheet may not go to a normal feeding path in a subsequent feeding operation, resulting in a conveyance error such as a jam. Japanese Patent Laid-Open No. 2011-37557 does not disclose any unit for solving such a problem.

SUMMARY OF THE INVENTION

It is an object of the present invention to provide a printing apparatus which is capable of performing automatic sheet feeding of an installed roll more reliably.

According to a first aspect of the present invention, there is provided a printing apparatus comprising a holding unit configured to hold a roll sheet being a continuous sheet wound in a roll form; a printing unit configured to perform printing on a sheet supplied from the holding unit; a driving unit configured to rotate in a first direction to cause the roll sheet held in the holding unit to rotate in a forward direction and supply the sheet to the printing unit; a sensor configured to change its output value in accordance with a distance to the sheet of the roll sheet held in the holding unit; a detecting unit configured to detect a leading end of the sheet on the basis of the output value of the sensor while causing the roll sheet to rotate in a reverse direction by causing the driving unit to rotate in a second direction opposite to the first direction; and a determining unit configured to determine a feeding state of the fed sheet on the basis of the output value of the sensor while feeding the sheet after switching a rotation direction of the driving unit from the second direction to the first direction after the detection.

Further features of the present invention will become apparent from the following description of exemplary embodiments with reference to the attached drawings.

DESCRIPTION OF THE EMBODIMENTS

Figure 1:
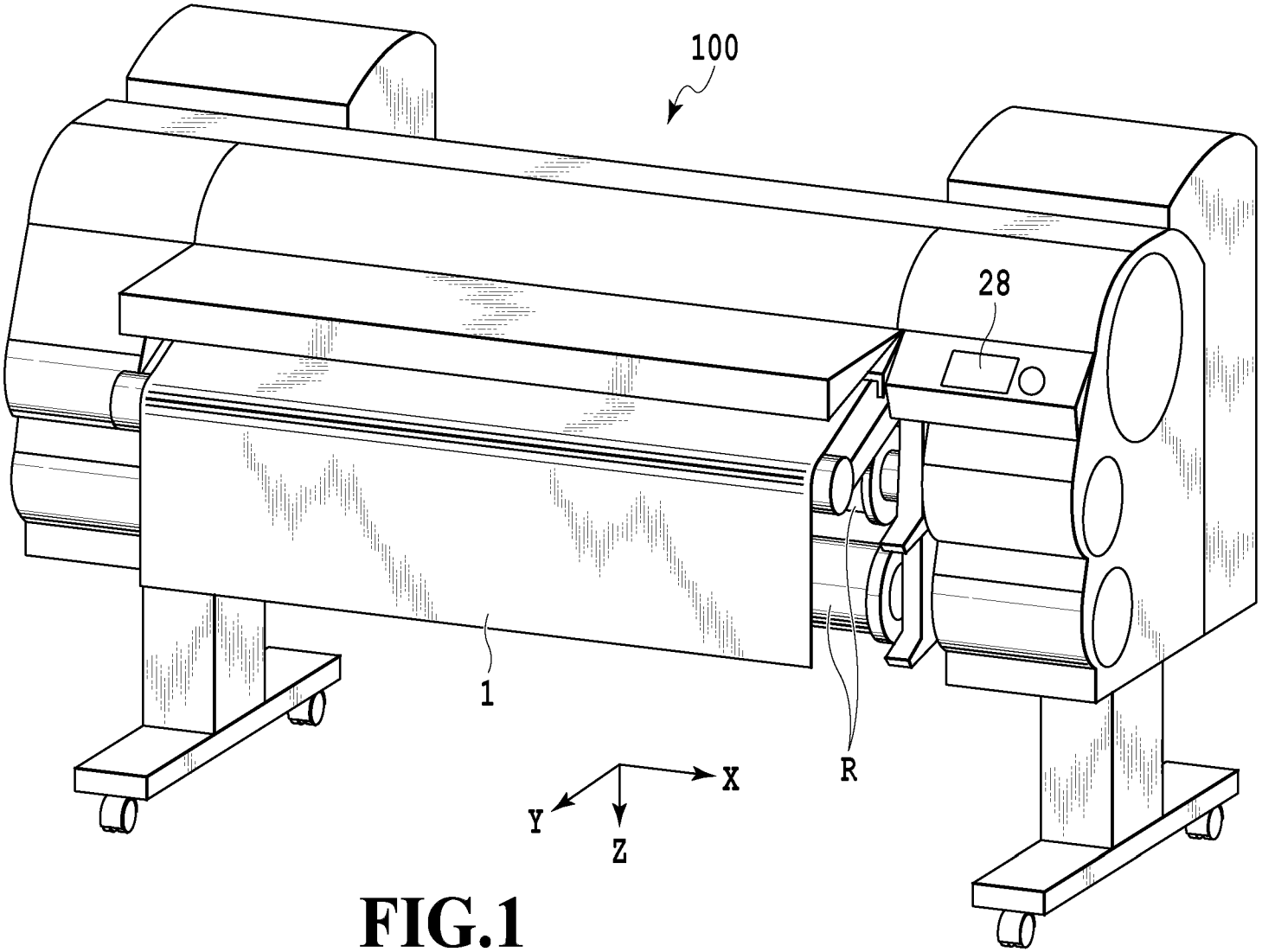
FIG. 1 is a perspective view of a printing apparatus according to a first embodiment of the present invention.

Hereinafter, exemplary embodiments of the present invention will be described with reference to the appended drawings. First, a basic configuration of the present invention will be described.

<Basic Configuration>

FIGS. 1 to 6 are explanatory diagrams of a basic configuration of a printing apparatus according to an embodiment of the present invention. A printing apparatus of the present example is an inkjet printing apparatus including a sheet supplying apparatus that supplies a sheet serving as a print medium and a printing unit that prints an image on a sheet. For the sake of description, coordinate axes are set as illustrated in the drawings. In other words, a sheet width direction of a roll R is set as an X-axis direction, a direction in which the sheet is conveyed in a printing unit 400 to be described later is set as a Y-axis direction, and a gravity direction is set as a Z-axis direction.

As illustrated in FIG. 1, in a printing apparatus 100 of the present example, the roll R (roll sheet) obtained by winding a sheet 1 which is a long continuous sheet (also referred to as a web) in a roll form can be set in each of two upper and lower roll holding units. An image is printed on the sheet 1 selectively pulled out of the rolls R. A user can input, for example, various commands to the printing apparatus 100 such as a command of designating a size of the sheet 1 or a command of performing switching between on-line and off-line using various switches installed in a manipulation panel 28.

Figure 2:
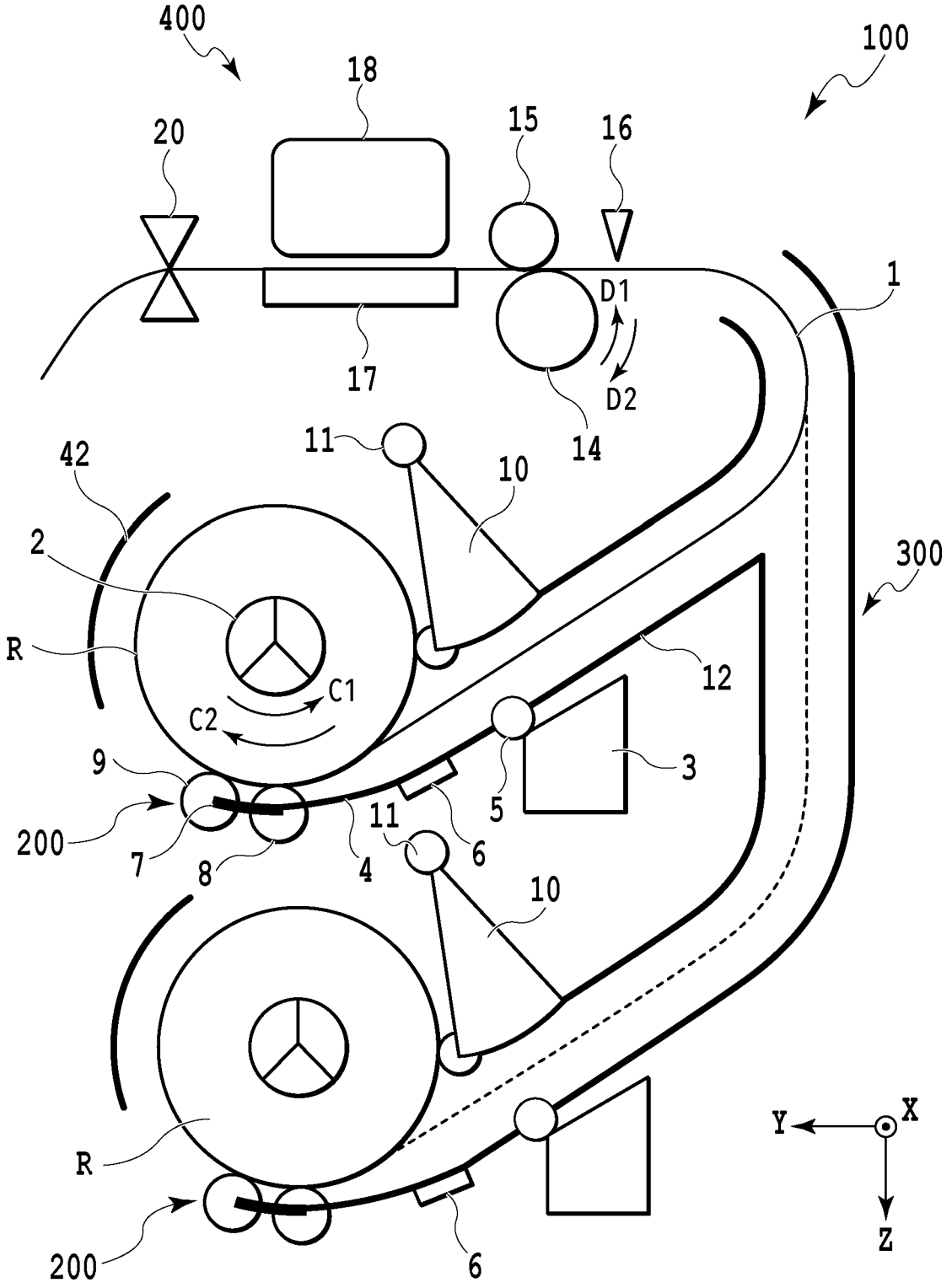
FIG. 2 is an explanatory diagram of a conveyance path of a sheet in a printing apparatus.

FIG. 2 is a schematic cross-sectional view of a main part of the printing apparatus 100. Two supplying apparatuses 200 corresponding to the two rolls R are installed one above the other. The sheet 1 pulled out of the roll R by the supplying apparatus 200 is conveyed to the printing unit 400 capable of printing an image along a sheet conveyance path through a sheet conveying unit (conveying mechanism) 300. The printing unit 400 prints an image on the sheet 1 by ejecting ink from an inkjet type print head 18. The print head 18 ejects ink from an ejection port using an ejection energy generating element such as an electrothermal transducer (heater) or a piezo element. The print head 18 is not limited only to the inkjet system, and a printing system of the printing unit 400 is not limited, and, for example, a serial scan system or a full line system may be used. In the case of the serial scan system, an image is printed in association with a conveyance operation of the sheet 1 and scanning of print head 18 in a direction intersecting with a conveyance direction of the sheet 1. In the case of the full line system, an image is printed, while continuously conveying the sheet 1, using the long print head 18 extending in a direction intersecting with the conveyance direction of the sheet 1.

The roll R is set in the roll holding unit of the supplying apparatus 200 in a state in which a spool member 2 is inserted in a hollow hole portion thereof, and the spool member 2 is driven by a motor 33 for roll driving (see FIG. 5) to rotate normally or reversely. The supplying apparatus 200 includes, as described later, a driving unit 3, an arm member (mobile body) 4, an arm rotational shaft 5, a sensor unit 6, a swing member 7, driven rotating bodies (contact bodies) 8 and 9, a separating flapper (upper side guide body) 10, and a flapper rotational shaft 11.

A conveyance guide 12 guides the sheet 1 to the printing unit 400 while guiding front and back surfaces of the sheet 1 pulled out of the supplying apparatus 200. A conveying roller 14 is rotated normally or reversely in directions of arrows D1 and D2 by a conveying roller driving motor 35 (see FIG. 5) to be described later. A nip roller 15 can be drivenly rotated in accordance with the rotation of the conveying roller 14 and can be brought into contact with or separated from the conveying roller 14 by a nip force adjusting motor 37 (see FIG. 5), and nip force thereof can be adjusted. A conveyance speed of the sheet 1 by the conveying roller 14 is set to be higher than a pulled-out speed of the sheet 1 by the rotation of the roll R, so that it is possible to apply back tension to the sheet 1 and convey the sheet 1 in a state in which the sheet 1 is stretched.

A platen 17 of the printing unit 400 regulates the position of the sheet 1, and a cutter 20 cuts the sheet 1 on which an image is printed. A cover 42 of the roll R prevents the sheet 1 on which an image is printed from entering the supplying apparatus 200. The operation in the printing apparatus 100 is controlled by a CPU 201 (see FIG. 5) to be described later.

Figure 3A:
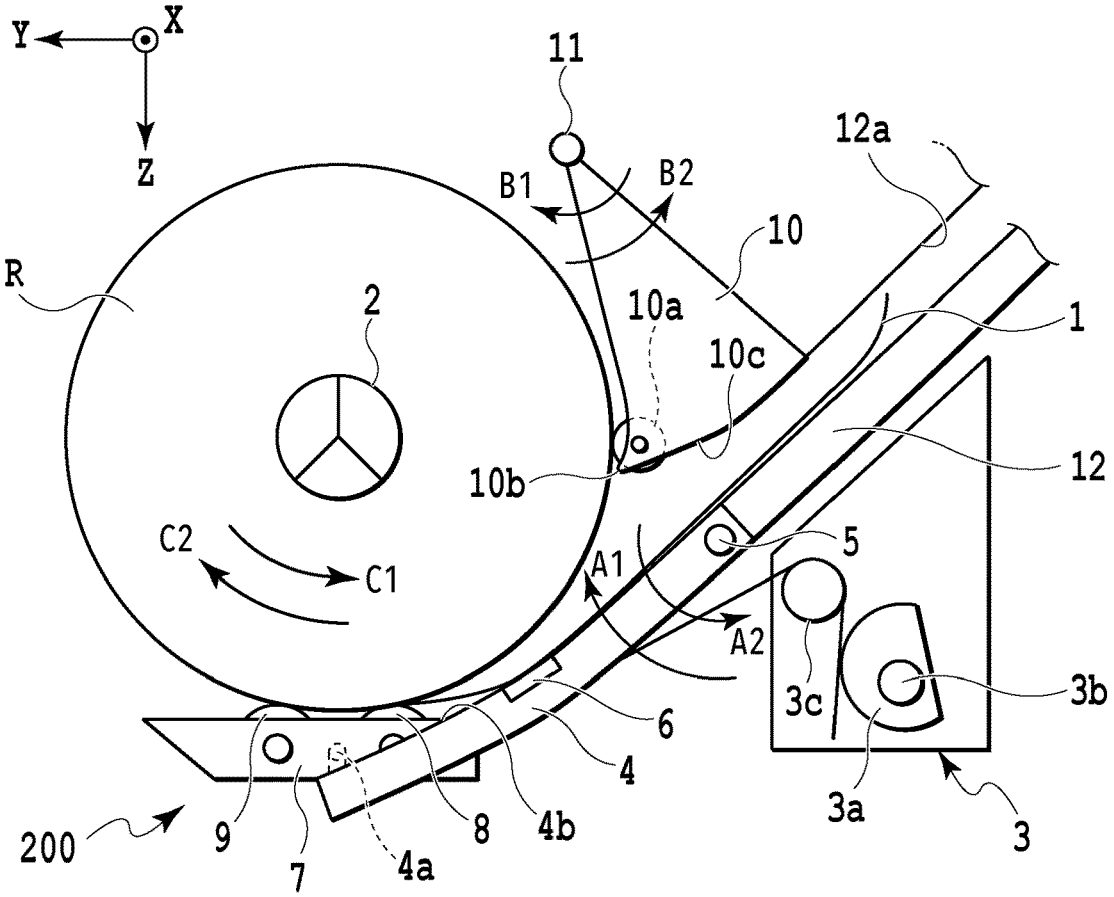
FIGS. 3A and 3B are explanatory diagrams of a sheet supplying apparatus.
Figure 3B:
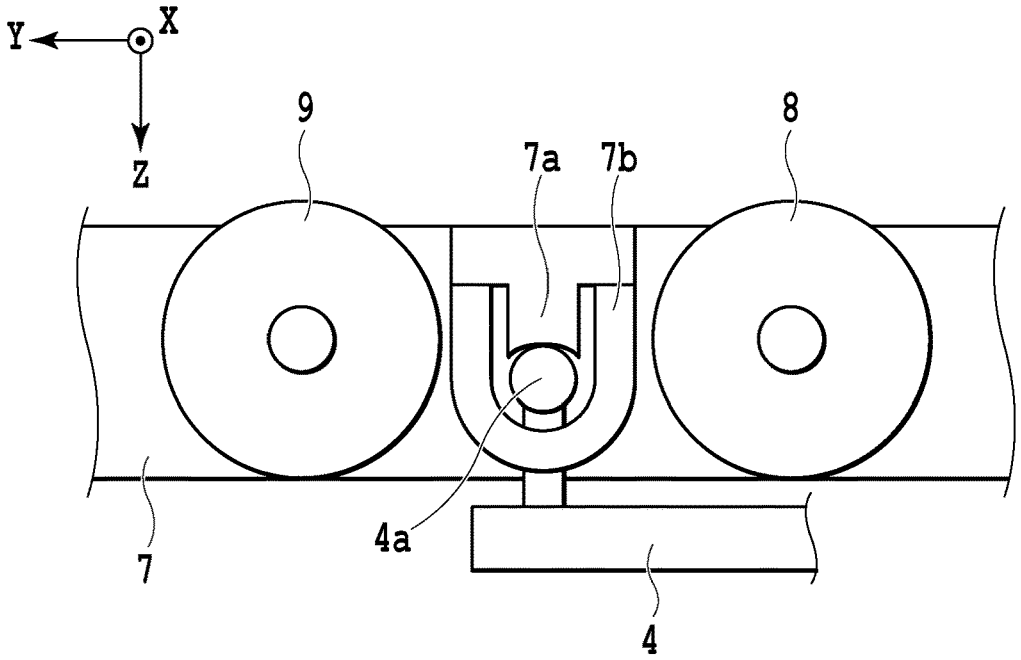

FIGS. 3A and 3B are explanatory diagrams of the supplying apparatus 200, and the roll R in FIG. 3A is in a state in which an outer diameter thereof is relatively large.

The arm member (mobile body) 4 is attached to the conveyance guide 12 to be rotatable in directions of arrows A1 and A2 on the arm rotational shaft 5. A guide portion 4*b* (lower guide body) that guides a lower surface of the sheet 1 (a front surface or a print surface of the roll sheet) pulled out of the roll R is formed on an upper part of the arm member 4. A helical torsion spring 3*c* that presses the arm member 4 in the direction of the arrow A1 is interposed between the arm member 4 and a rotating cam 3*a* of the driving unit 3. The rotating cam 3*a* is rotated by a pressing force adjusting motor 34 (see FIG. 5) to be described later, and force in which the helical torsion spring 3*c* presses the arm member 4 in the direction of the arrow A1 changes in accordance with the rotational position thereof. When the leading end portion of the sheet 1 (a part of the sheet 1 including a leading end) is set in the sheet supply path between the arm member 4 and a separating flapper 10, the pressing force of the arm member 4 by the helical torsion spring 3*c* is switched to three stages depending on the rotational position of the rotating cam 3*a*. In other words, the pressing force of the arm member 4 is switched to a pressing state by a comparatively small force (pressing force of a weak nip), a pressing state by a relatively large force (pressing force of a strong nip), and a pressing force releasing state.

The swing member 7 is swingably attached to the arm member 4, and the first and second driven rotating bodies (rotating bodies) 8 and 9 which are positioned to deviate in a circumferential direction of the roll R are rotatably mounted to the swing member 7. The driven rotating bodies 8 and 9 move in accordance with an outer shape of the roll R and come into pressure contact with the outer circumferential portion of the roll R from a lower side in the gravity direction in accordance with pressing force against the arm member 4 in the direction of arrow A1. In other words, the driven rotating bodies 8 and 9 come into pressure contact with the outer circumference portion of the roll R from a lower side in the gravity direction than a central shaft of the roll R in the horizontal direction. The pressure contact force is changed in accordance with pressing force of pressing the arm member 4 in the direction of arrow A1.

A plurality of arm members 4 each including the swing member 7 are installed at a plurality of different positions in the X-axis direction. As illustrated in FIG. 3B, the swing member 7 includes a bearing portion 7*a* and a shaft fastening portion 7*b*, and thus the rotational shaft 4*a* of the arm member 4 is accepted with predetermined looseness.

The bearing portion 7*a* is installed at a center of gravity position of the swing member 7 and supported by the rotational shaft 4*a* so that the swing member 7 has a stable attitude in each of the X-axis direction, the Y-axis direction, and the Z-axis direction. Further, since the rotational shaft 4*a* is accepted with looseness, any one of a plurality of swing members 7 is displaced along the outer circumference portion of the roll R depending on the pressing force against the arm member 4 in the direction of the arrow A1. With such a configuration (equalizing mechanism), a change in a pressure contact attitude of the first and second driven rotating bodies 8 and 9 with respect to the outer circumferential portion of the roll R is permitted. As a result, a contact region between the sheet 1 and the first and second driven rotating bodies 8 and 9 is kept at maximum, and the pressing force against the sheet 1 is equalized, and thus a variation in the conveyance force of the sheet 1 can be suppressed. Since the driven rotating bodies 8 and 9 come into pressure contact with the outer circumference portion of the roll R, the occurrence of slack in the sheet 1 is suppressed, and the conveyance force thereof is enhanced.

In a main body of the printing apparatus 100 (printer main body), the separating flapper 10 positioned above the arm member 4 is attached to be rotatable on the flapper rotational shaft 11 in the directions of the arrows B1 and B2. The separating flapper 10 is configured to lightly press the outer circumferential surface of the roll R by its own weight. In a case in which it is necessary to more strongly press the roll R, biasing force by a biasing member such as a spring may be used. A driven roller (upper contact body) 10*a* is rotatably installed at a contact portion of the separating flapper 10 with the roll R to suppress influence of the pressing force on the sheet 1. A separating unit 10*b* of the leading end of the separating flapper 10 is formed to extend up to a position as close to the front surface of the roll R as possible in order to facilitate the separation of the leading end portion of the sheet from the roll R.

The sheet 1 is supplied through the supply path formed between the separating flapper 10 and the arm member 4 after the front surface (print surface) of the roll sheet is guided by the upper guide portion 4*b* of the arm member 4. Accordingly, it is possible to smoothly supply the sheet 1 using the weight of the sheet 1. Further, depending on the outer diameter of the roll R, even when the outer diameter of the roll R changes due to the movement of driven rotating bodies 8 and 9 and the guide portion 4*b*, it is possible to reliably pull out the sheet 1 from the roll R and convey the sheet.

One of the features of the apparatus according to the present embodiment lies in an automatic sheet loading function (an automatic sheet feeding function). In the automatic loading, when the user sets the roll R in the apparatus, the apparatus detects the leading end of the sheet while rotating the roll R in a opposite direction (which is referred to a second direction of arrow C2 in FIG. 3A) opposite to a rotation direction (a first direction, that is, a direction of the arrow C1 in FIG. 3A) when the sheet is supplied. The sensor unit 6 detects the separation of the leading end portion of the sheet 1 from the outer circumferential surface of the roll R. If the sensor unit 6 detects the separation of the leading end portion of the sheet 1 from the outer circumferential surface of the roll sheet wound inward, the apparatus rotates the roll R in the first direction and supplies the leading end portion of the sheet 1 to the inside of the sheet supply path between the arm member 4 and the separating flapper 10. A more detailed procedure of the automatic loading function will be described later.

Further, the printing apparatus 100 of the present example includes the two upper and lower supplying apparatuses 200, and it is possible to perform switching from a state in which the sheet 1 is supplied from one supplying apparatus 200 to a state in which the sheet 1 is supplied from the other supplying apparatus 200. In this case, one supplying apparatus 200 rewinds the sheet 1 which has been supplied so far on the roll R. The leading end of the sheet 1 is evacuated up to the position at which it is detected by sensor unit 6.

Figure 4:
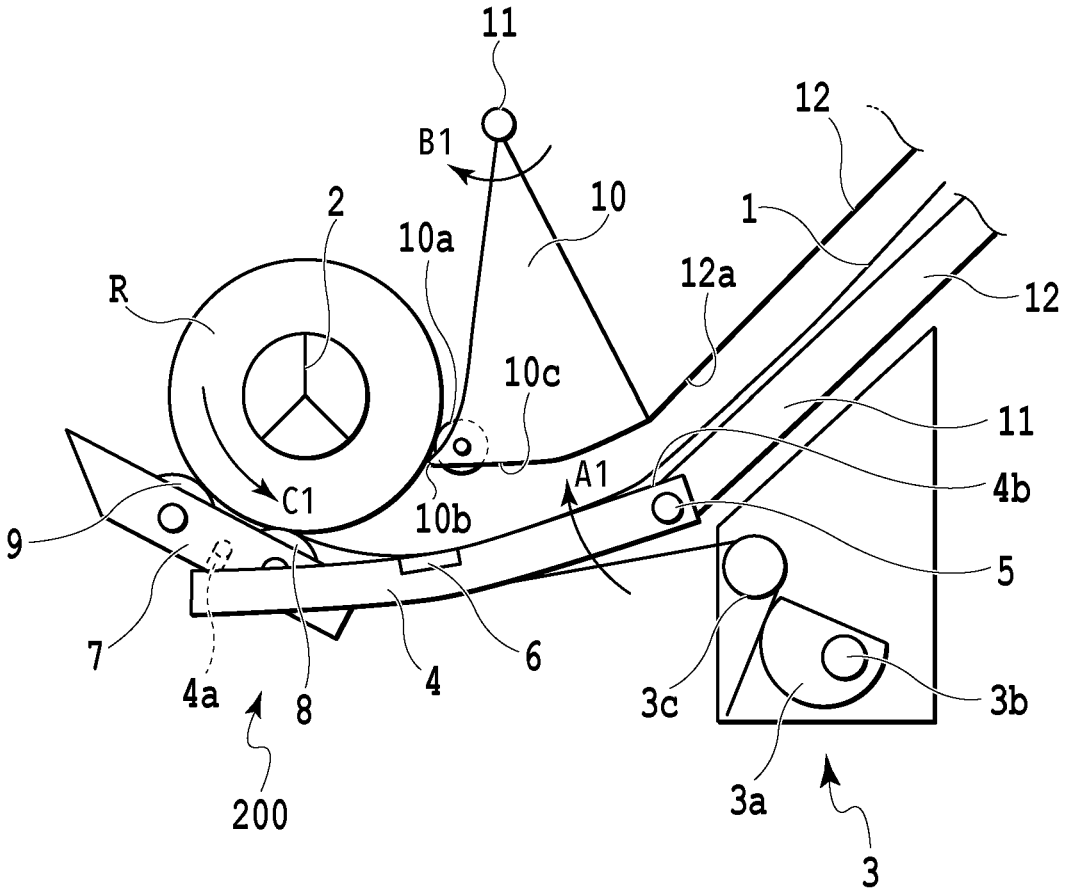
FIG. 4 is an explanatory diagram of a sheet supplying apparatus when a roll outer diameter is small.

FIG. 4 is an explanatory diagram of the supplying apparatus 200 when the outer diameter of the roll R is relatively small.

Since the arm member 4 is pressed in the direction of the arrow A1 by the helical torsion spring 3*c*, the arm member 4 moves in the direction of the arrow A1 in accordance with a decrease in the outer diameter of the roll R. Further, by rotating the rotating cam 3*a* in accordance with the change in the outer diameter of the roll R, the pressing force of the arm member 4 by the helical torsion spring 3*c* can be maintained within a predetermined range even though the change in the outer diameter of the roll R changes. Since the separating flapper 10 is also pressed in the direction of arrow B1, the separating flapper 10 moves in the direction of arrow B1 in accordance with the decrease in the outer diameter of the roll R. Accordingly, even when the outer diameter of the roll R is decreased, the separating flapper 10 forms the supply path with the conveyance guide 12 and guides the upper surface of the sheet 1 by a lower surface 10*c*. As described above, the arm member 4 and the separating flapper 10 are rotated in accordance with the change in the outer diameter of the roll R, and thus even when the outer diameter of the roll R is changed, the supply path having a substantially constant size is formed between the arm member 4 and the separating flapper 10.

Figure 5:
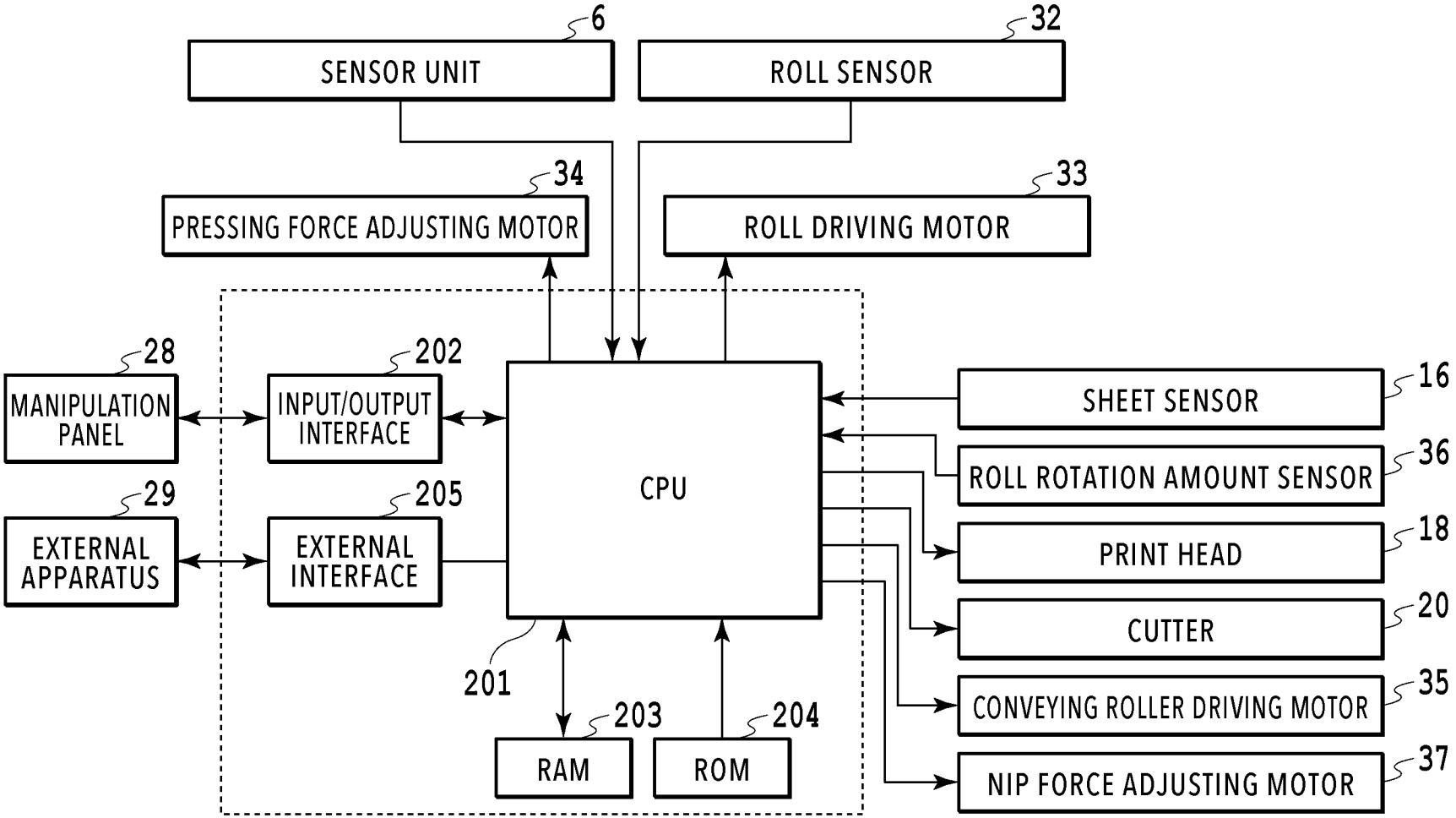
FIG. 5 is a block diagram for describing a control system of a printing apparatus.

FIG. 5 is a block diagram for describing a configuration example of a control system in the printing apparatus 100. The CPU 201 of the printing apparatus 100 controls the respective units of the printing apparatus 100 including the supplying apparatus 200, the sheet conveying unit 300, and the printing unit 400 in accordance with a control program stored in a ROM 204. A type and a width of the sheet 1, various setting information, and the like are input to the CPU 201 from the manipulation panel 28 via an input/output interface 202. Further, the CPU 201 is connected to various external apparatuses 29 including a host apparatus such as a personal computer via an external interface 205, and exchanges various information such as print data with the external apparatus 29. Further, the CPU 201 performs writing and reading of information related to the sheet 1 and the like on a RAM 203. The motor 33 is a roll driving motor for rotating the roll R normally or reversely through the spool member 2, and constitutes a driving mechanism (rotation mechanism) capable of rotationally driving the roll R. The pressing force adjusting motor 34 is a motor for rotating the rotating cam 3*a* in order to adjust the pressing force against the arm member 4. The conveying roller driving motor 35 is a motor for rotating the conveying roller 14 normally or reversely. A roll sensor 32 is a sensor for detecting the spool member 2 of the roll R when the roll R is set in the supplying apparatus 200. A roll rotation amount sensor 36 is a sensor (rotational angle detection sensor) for detecting a rotation amount of the spool member 2, that is, the roll R and is, for example, a rotary encoder that outputs pulses which correspond in number to the rotation amount of the roll R.

<Sheet Supply Preparation Process>

Figure 6:
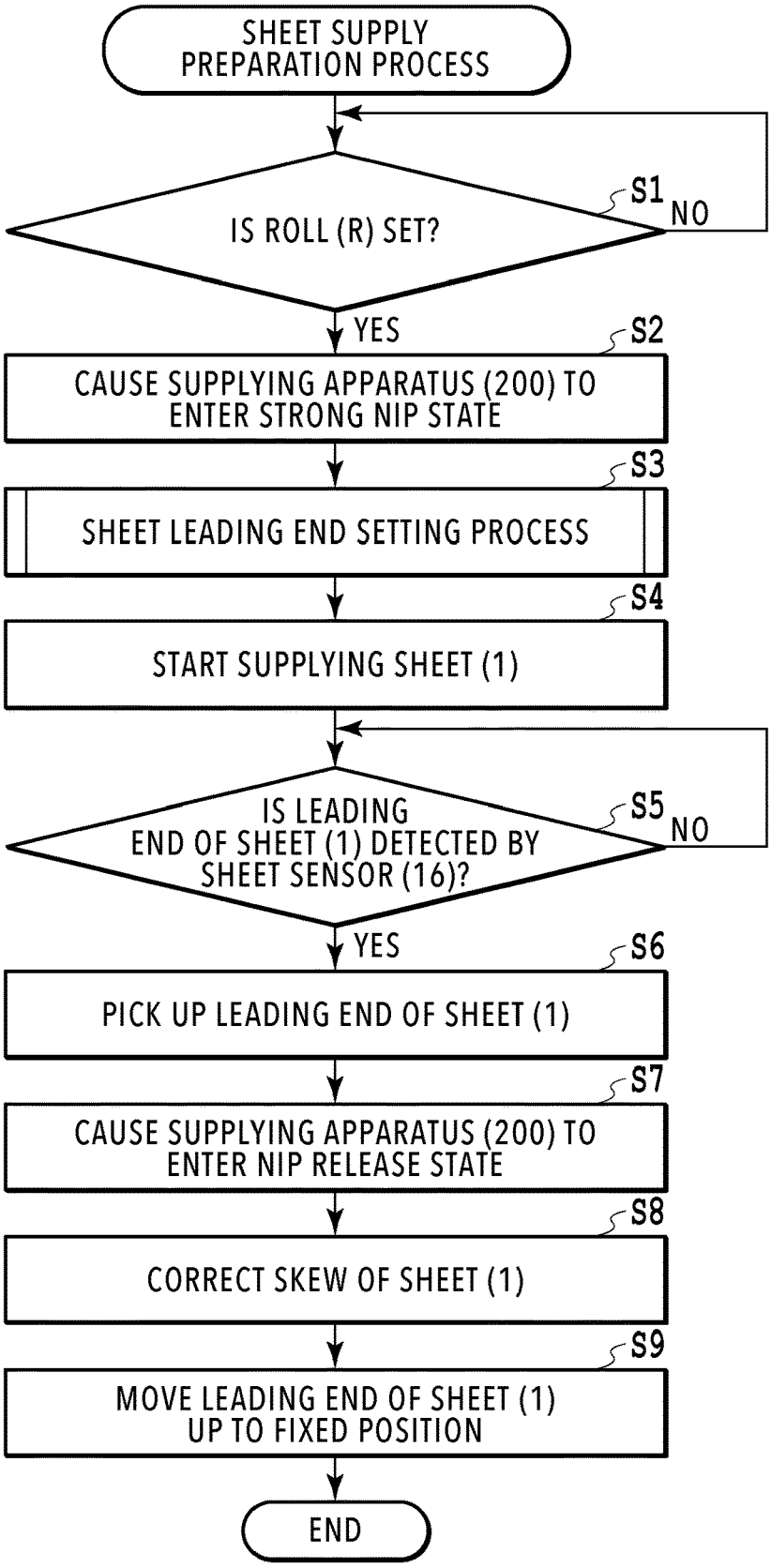
FIG. 6 is a flowchart for describing a sheet supply preparation operation.

FIG. 6 is a flowchart for describing a supply preparation process of the sheet 1 starting from the setting of the roll R.

The CPU 201 of the printing apparatus 100 stands by in a state in which the arm member 4 is pressed in the direction of the arrow A1 by "weak pressing force" (a weak nip state), and first determines whether or not the roll R is set (step S1). In the present example, when the roll sensor 32 detects the spool member 2 of the roll R, the roll R is determined to be set. After the roll R is set, the CPU 201 switches a state in which the arm member 4 is pressed in the direction of the arrow A1 by "strong pressing force" (a strong nip state) (step S2). Then, the CPU 201 executes a sheet leading end setting process in which the leading end portion of the sheet 1 is set in the sheet supply path between the arm member 4 and the separating flapper 10 (step S3). With the sheet leading end setting process (automatic loading), the leading end portion of the sheet 1 is set (inserted) in the sheet supply path. The sheet leading end setting process will be described later in detail.

Thereafter, the CPU 201 rotates the roll R in the direction of the arrow C1 by the roll driving motor 33 and starts supplying the sheet 1 (step S4). When the leading end of the sheet 1 is detected by a sheet sensor 16 (step S5), the CPU 201 normally rotates the conveying roller 14 in a direction of arrow D1, picks up the leading end of the sheet 1, and then stops the motor 33 and the motor 35 (step S6). Thereafter, the CPU 201 cancels the pressing force of pressing the arm member 4 in the direction of arrow A1, and causes the first and second driven rotating bodies 8 and 9 to be separated from the roll R (to enter a nip release state) (step S7).

Thereafter, the CPU 201 determines whether the sheet is conveyed (skewed) in a state in which the sheet is obliquely inclined in the sheet conveying unit 300. Specifically, the sheet 1 is conveyed by a predetermined amount in the sheet conveying unit 300, and an amount of skew occurring at that time is detected by a sensor installed in a carriage including the print head 18 or the sheet conveying unit 300. When the amount of skew is larger than a predetermined allowable amount, the sheet 1 is repeatedly fed or back-fed with the normal rotation and the reverse rotation of the conveying roller 14 and the roll R while applying back tension to the sheet 1. With this operation, the skew of the sheet 1 is corrected (step S8). As described above, when the skew of the sheet 1 is corrected or when an operation of printing an image on the sheet 1 is performed, the supplying apparatus 200 is set to enter the nip release state. Thereafter, the CPU 201 causes the sheet conveying unit 300 to move the leading end of the sheet 1 to a standby position (a fixed position) before printing starts in the printing unit 400 (step S9). Accordingly, the preparation for supplying the sheet 1 is completed. Thereafter, the sheet 1 is pulled out of the roll R with the rotation of the roll R and conveyed to the printing unit 400 by the sheet conveying unit 300.

The sheet leading end setting process (step S20) of FIG. 5 in the basic configuration of the printing apparatus 100 will be described below as embodiments of the present invention.

First Embodiment

Figure 7:
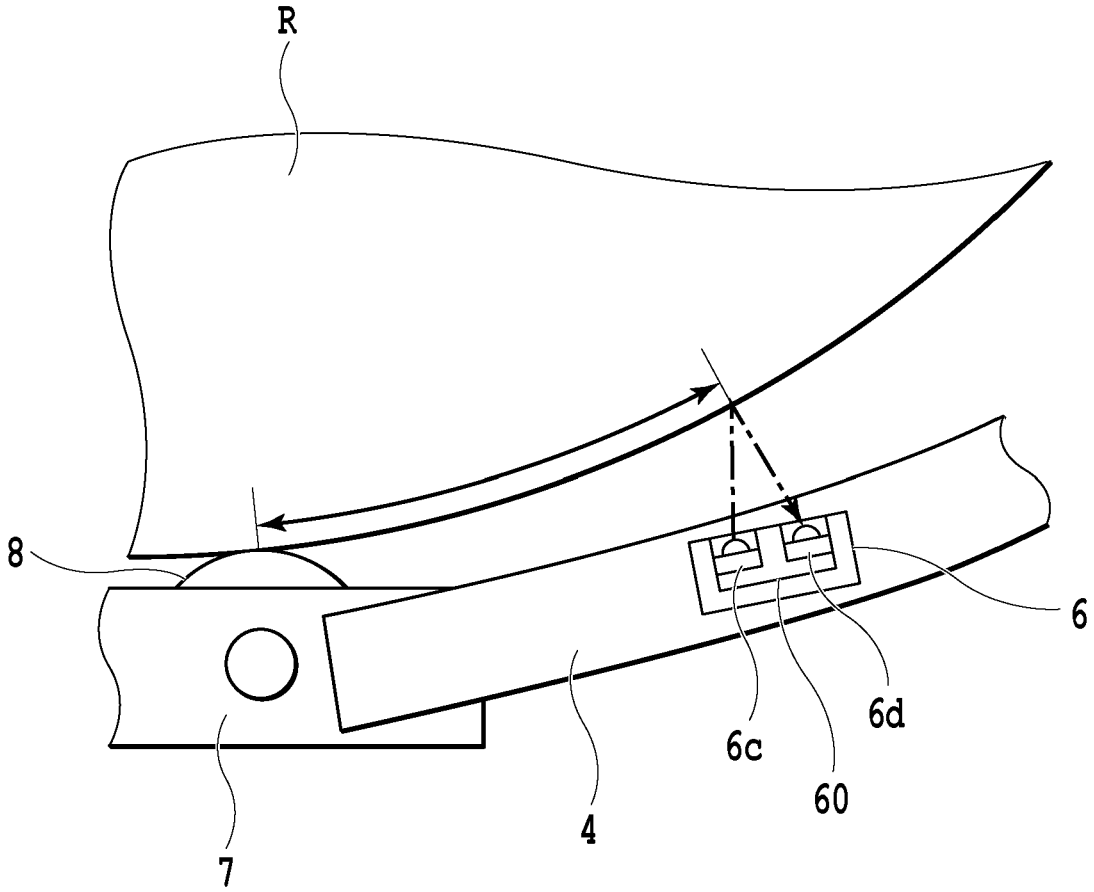
FIG. 7 is a detailed diagram of a sensor unit.

FIG. 7 is a detailed diagram of the sensor unit 6 used in the present embodiment. An optical sensor 60 including a light emitting unit 6*c* such as an LED, an OLED, an LD, and a light receiving unit 6*d* such as a photodiode is arranged in the sensor unit 6. The light receiving unit 6*d* detects light which is emitted from the light emitting unit 6*c* and reflected by a front surface of the roll sheet (a print surface serving as the outer circumferential surface in the roll). In this case, as a distance between the optical sensor 60 and the roll sheet decreases, the amount of light received by the light receiving unit 6*d* increases, and an output value thereof increases. To the contrary, as the distance increases, the amount of light received by the light receiving unit 6*d* decreases, and the output value of the sensor 60 decreases.

Here, a case in which the CPU 201 causes the roll R to rotate in a second direction (C2 direction) while detecting the output of the optical sensor 60 under the above configuration is considered. At this time, the sheet leading end F deviates from the driven roller 10*a* of the separating flapper 10, falls down onto the arm member 4, and then passes through the detection position of the optical sensor 60 on the sensor unit 6. In the present embodiment, the leading end of the sheet 1 is detected by detecting a change in the detection output of the optical sensor 60 at this time.

This will be described in detail. When the leading end F of the sheet 1 passes through the driven roller 10*a* of the separating flapper 10 and falls down onto the arm member 4 with the rotation of the roll R in the second direction (C2 direction), the optical sensor 60 and the front surface of the sheet 1 detected by the optical sensor 60 get closer to each other abruptly, and the output value of the optical sensor 60 changes from a low value to a high value. Further, if the roll R rotates in the C2 direction, a high output value is maintained for a while, but when the sheet leading end F passes through the detection position of the optical sensor 60, the output value of the optical sensor 60 transitions to a low value. The CPU 201 determines whether or not the sheet leading end F passes through by detecting such a change in the output value in association with the rotation amount detected by the roll rotation amount sensor 36. Thereafter, the CPU 201 feeds the sheet leading end F detected by the above method into the supply path.

Figure 8A:
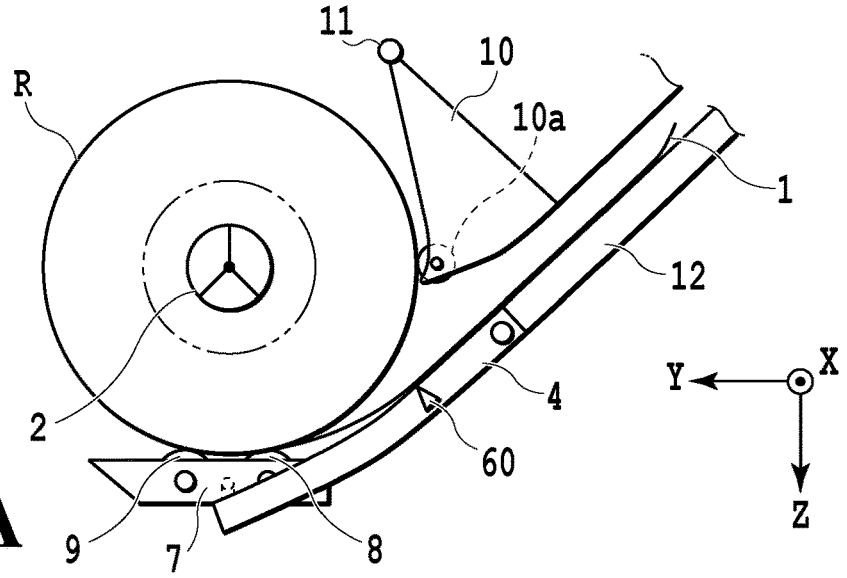
FIGS. 8A to 8C are diagrams illustrating various feeding states of a sheet at the time of feeding.
Figure 8B:
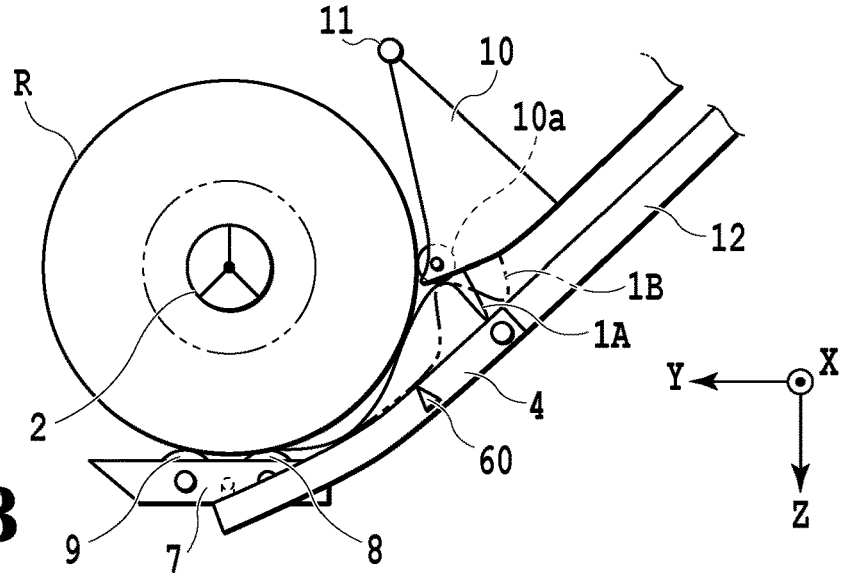
Figure 8C:
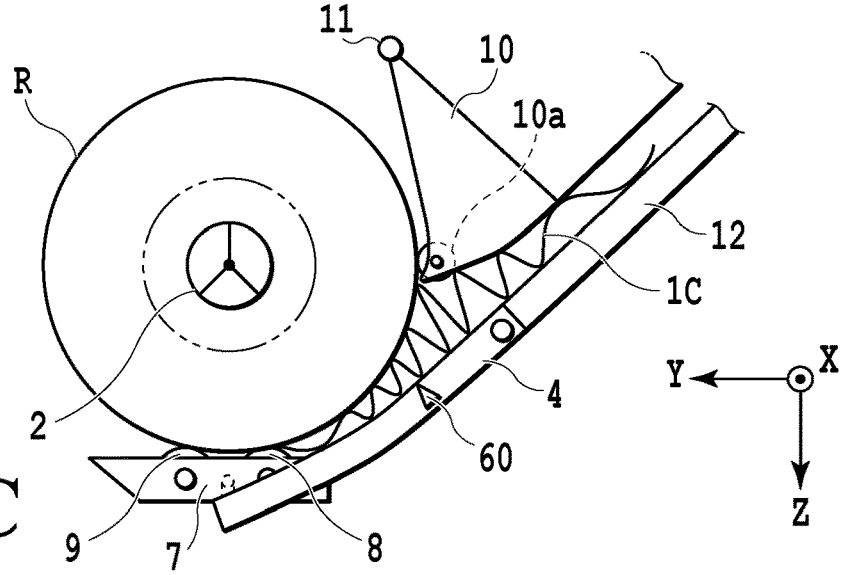
Figure 9A:
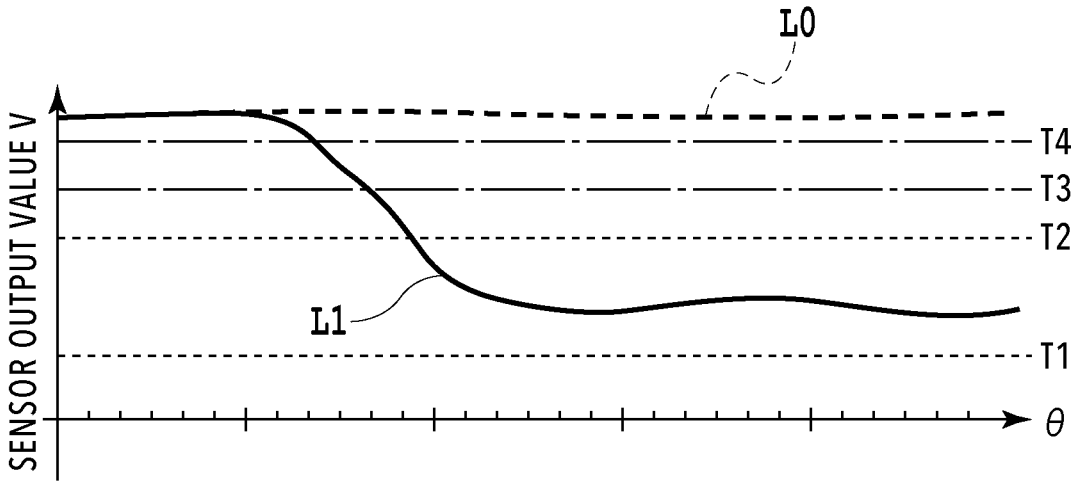
FIGS. 9A and 9B are diagrams illustrating output values of a sensor unit corresponding to feeding states.
Figure 9B:
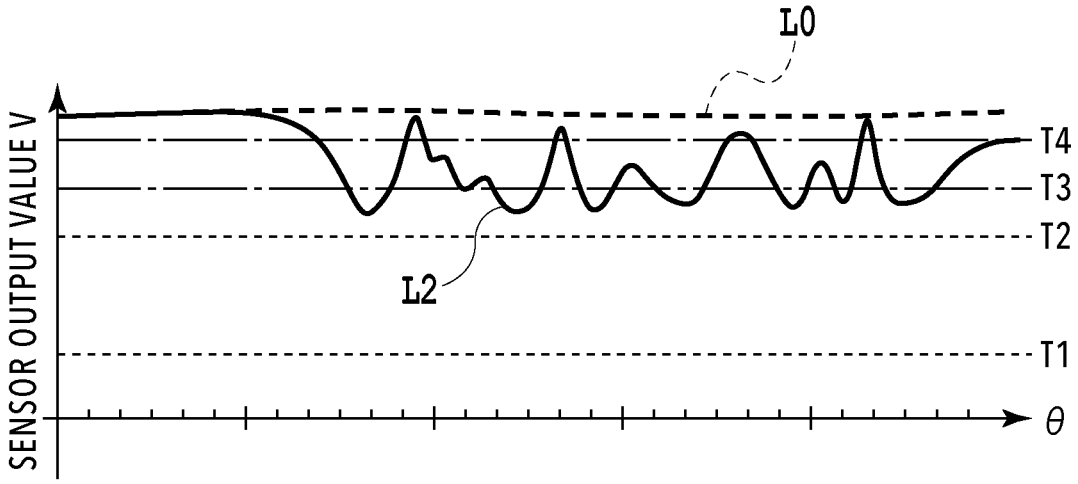

FIGS. 8A to 8C illustrate various feeding states of the sheet 1 at the time of feeding. FIGS. 9A and 9B are diagrams illustrating an output value V of the sensor unit 6 corresponding to each of the feeding states illustrated in FIGS. 8A to 8C. In FIGS. 9A and 9B, a horizontal axis denotes a rotational angle θ of the roll R, and a vertical axis denotes the output value V of the optical sensor 60.

FIG. 8A illustrates a state in which the sheet 1 is normally fed along the arm member 4. In FIG. 8A, the sheet 1 moves along the conveyance guide 12 while being supported by it, and no sheet jam occurs. In this case, the sheet 1 moves at a position close to the optical sensor 60, and the output value V is maintained at the high value as indicated by a broken line L0 illustrated in FIGS. 9A and 9B.

FIG. 8B illustrates a state in which the sheet leading end F is broken or damaged and abuts on the driven roller 10*a*, and the fed sheet 1 is buckled. A sheet 1A indicated by a solid line in FIG. 8B is lifted from the arm member 4 and apart from the sensor unit 6 as compared with FIG. 8A. In this case, the output value V of sensor unit 6 is maintained at the low value after a certain rotational angle as indicated by a solid line L1 in FIG. 9A. In the present embodiment, in a case in which an output change such as a solid line L1 of the sensor unit 6 is detected, the CPU 201 determines that a sheet jam is likely to occur.

On the other hand, in FIG. 8B, a part of a sheet 1B indicated by a dotted line is at a position close to the sensor unit 6 in a state in which the sheet 1B is buckled. In this case, the output value V of the optical sensor 60 is maintained at the high value, and it is difficult to distinguish it from the normal feeding as illustrated in FIG. 8A from the output value at this time point. However, in a case in which the roll R is caused to rotate in a first direction (C1 direction) further from this state, the sheet 1B becomes a bellows state as indicated by a sheet 1C of FIG. 8C.

If the sheet 1C in the bellows state moves with the rotation of the roll R, the distance between the optical sensor 60 and the sheet 1 gets closer or is separated from each other. Therefore, the output value V of the optical sensor 60 changes to increase and decrease repeatedly after a certain rotational angle as indicated by a solid line L2 in FIG. 9B. Therefore, in the present embodiment, it is determined that the sheet jam is likely to occur also when the output change such as the solid line L2 is detected at the feeding.

Figure 10:
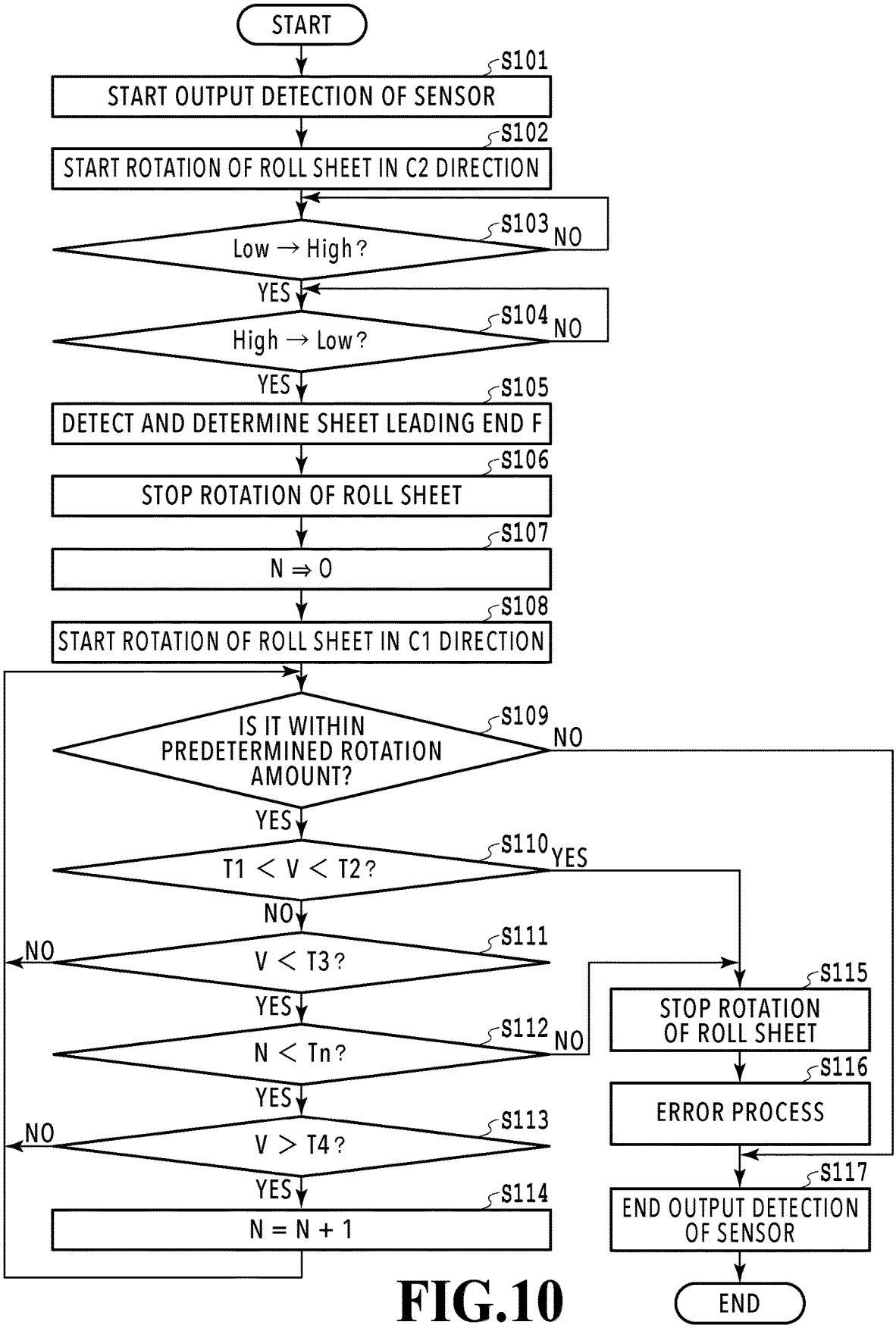
FIG. 10 is a flowchart for describing a process of a sheet leading end setting process.

FIG. 10 is a flowchart for describing a specific process executed by the CPU 201 in the sheet leading end setting process described in step S3 of FIG. 6. This process mainly includes an end portion detection process of detecting the leading end of the sheet 1 and a determination process (a jam detection process) of determining the feeding state of the sheet 1 after the leading end is detected.

When the present process is started, the CPU 201 first starts output detection of the optical sensor 60 in step S101. Then, the CPU 201 causes the process to proceed to step S102, and starts the rotation of the roll R in the C2 direction. Specifically, the CPU 201 drives the roll driving motor 33 in the second direction while counting the rotation amount of the roll R through the roll rotation amount sensor 36, to rotate the roll R in the winding direction (reverse direction), that is, the C2 direction in the drawing, at a constant speed.

Then, the CPU 201 causes the process to proceed to step S103 and determines whether or not the output value V of the optical sensor 60 switches from Low to High with respect to a predetermined threshold value T0. Here, the switching from Low to High indicates that the sheet leading end F deviates from the driven roller 10*a* of the separating flapper 10 and falls down onto the arm member 4. In a case in which it is determined in step S103 that the output value V of the optical sensor 60 switches from Low to High, the CPU causes the process to proceed to step S104.

Further, in step S104, the CPU 201 determines whether or not the output value V of the optical sensor 60 switches from High to Low with respect to the threshold value T0. Here, the switching from High to Low indicates that the sheet leading end F has passed over the sensor unit 6. In a case in which it is determined in step S104 that the output value V of the optical sensor 60 switches from High to Low, the CPU causes the process to proceed to step S105, determines that the sheet leading end F is detected, and stores a current rotational angle in the RAM 203. Then, the process proceeds to step S106, in which the CPU 201 stops the rotation of the roll R in the C2 direction.

Then, the CPU 201 causes the process to proceed to step S107 and resets a counter N (N=0). The counter N is a variable for counting the number of times that the output value of the optical sensor 60 fluctuates beyond a predetermined threshold value after the feeding operation is started.

In step S108, the CPU 201 starts rotating the roll R in the forward direction (in the C1 direction in the drawing). Specifically, the CPU 201 drives the roll driving motor 33 in the first direction while counting the rotation amount of the roll R through the roll rotation amount sensor 36 to rotate the roll R in a feeding direction (the forward direction), that is, the direction C1 in the drawing. Accordingly, the leading end F of the sheet 1 detected in step S105 moves between the arm member 4 and the separating flapper 10.

In step S109, the CPU 201 determines whether or not a predetermined rotation amount is exceeded since the rotation of the roll R is started in step S108. Here, the predetermined rotation amount is a rotation amount to the extent that the sheet 1 can be regarded as normally reaching a sheet supply port when a conveyance abnormality of the sheet 1 is not detected. In a case in which the CPU 201 determines that the predetermined rotation amount is exceeded, the CPU 201 ends the output detection of the optical sensor 60 at step S117, and ends the present process, that is, the sheet leading end setting process (step S3 in FIG. 6). On the other hand, in a case in which the predetermined rotation amount is not exceeded in step S109, the CPU 201 causes the process to proceed to step S110.

In step S110, the CPU 201 determines whether or not the output value V of the optical sensor 60 is included in ranges of predetermined threshold values T1 and T2. In the present embodiment, the threshold values T1 and T2 are threshold values for determining whether or not the sheet 1 is in the buckled state such as the solid line 1A illustrated in FIG. 8B.

In a case where the sheet 1 passing over the sensor unit 6 transitions to a state such as the solid line 1A with the rotation of the roll R in the C1 direction, the sensor 60 and the sheet 1 transition from a proximity state to a non-proximity state, and the sensor output value decreases. In the present embodiment, the upper limit threshold value T2 is a sensor output value for determining the non-proximity state if the sensor output value is lower than the upper limit threshold value T2. A method of setting the threshold value T2 is not particularly limited, but for example, the following method can be employed.

Figure 11A:
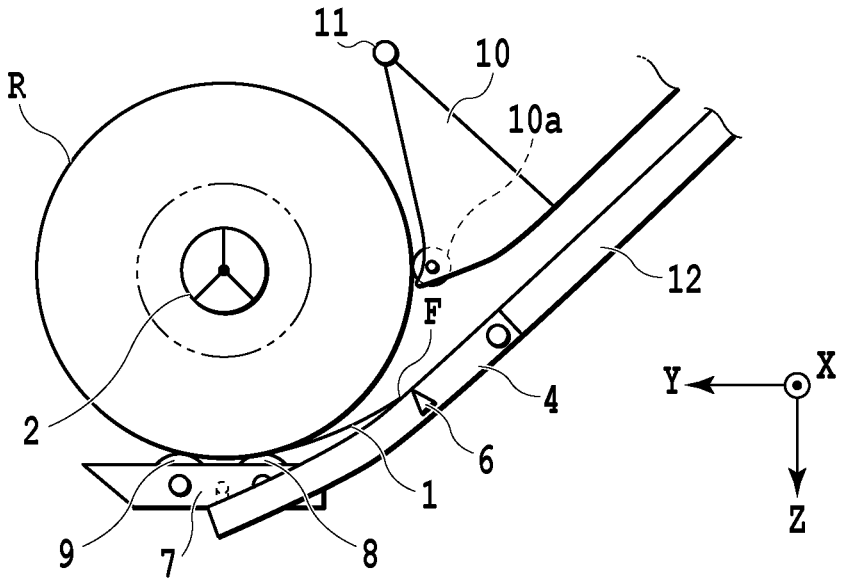
FIGS. 11A and 11B are diagrams for describing a method of setting a threshold value used in a sheet leading end setting process.
Figure 11B:
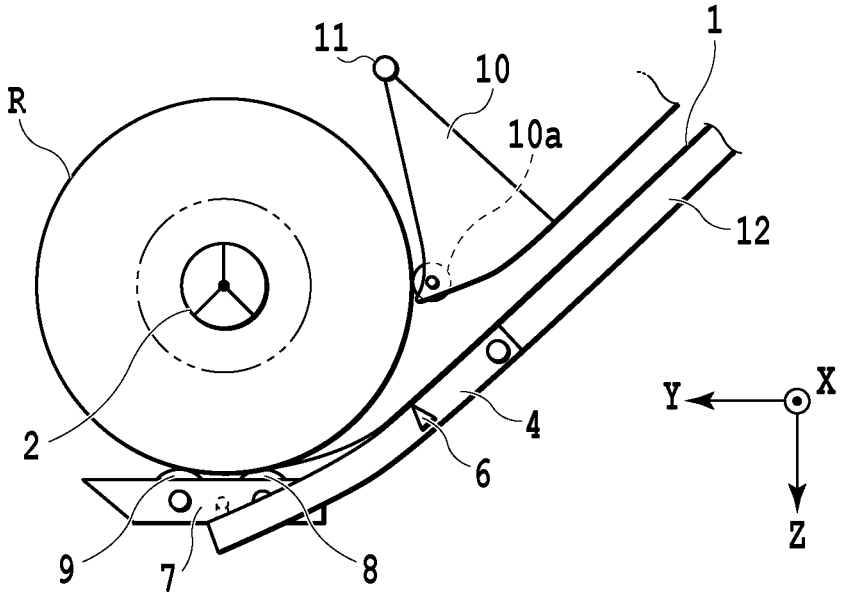

First, as illustrated in FIG. 11A, an output value Fv obtained when the sensor 60 detects the outer circumferential surface of the roll R before the sensor leading end F reaches a detection area of the sensor 60 is acquired in advance. Further, as illustrated in FIG. 11B, an output value Nv obtained when the sensor 60 detects the sheet 1 which is normally conveyed after the sheet leading end F passes through the detection region of the sensor 60 is acquired in advance. Then, the lower limit threshold value T2 is calculated in accordance with the following formula using the output values Fv and Nv.

$$T2=(Fv+Nv)/2\times0.2$$

In this case, the lower limit threshold value T2 is set with respect to an average value of Fv and Nv in consideration of a variation of about 20% in the output value which is caused by meandering or floating of the sheet 1.

Figure 12:
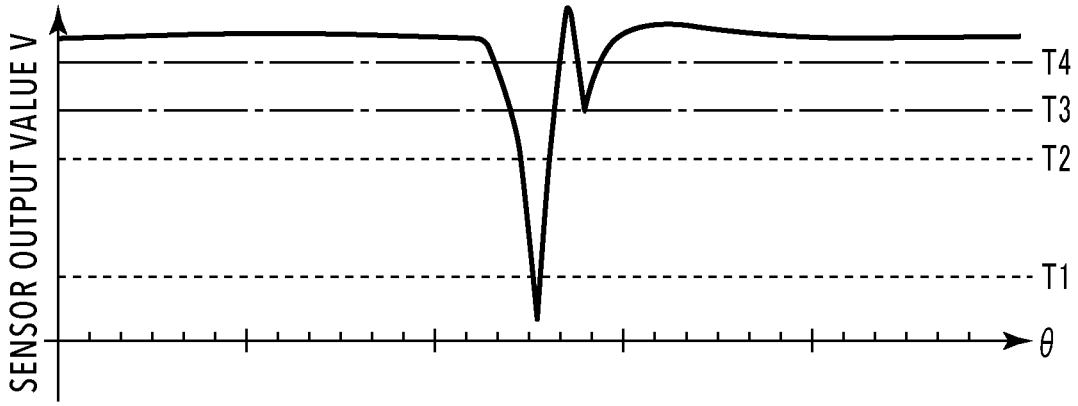
FIG. 12 is a diagram illustrating an installation position of a vibration sensor used in a second embodiment.

On the other hand, regarding the output value V of the optical sensor 60 while rotating the roll R, even if the sheet 1 moves normally, there are cases in which the output value V suddenly fluctuates due to an impact or the like caused by disturbance as illustrated in FIG. 12. In this case, the output value V decreases abruptly but is recovered early and has no relation with the conveyance state of the sheet 1, and it is preferable to ignore the output fluctuation. Therefore, in the present embodiment, the sensor output value for determining that it is a disturbance fluctuation since the output value V is much lower than the upper limit threshold value T2 is set as the lower limit threshold value T1. The lower limit threshold value T1 is also not particularly limited but can be set using, for example, the following Formula.

$$T1=Fv\times0.8$$

Here, an output value which is 20% further reduced from the minimum Fv which can be assumed within a range of normal conveyance is set as the threshold value T1 for distinguishing it from the disturbance. As described above, in the present embodiment, in order to reliably detect the buckled state such as the solid line L1 in FIG. 9A while excluding the sudden fluctuation caused by the disturbance as illustrated in FIG. 12, the threshold values T1 and T2 are prepared.

The description returns to the flowchart of FIG. 10. In a case where the output value V satisfies T1<V<T2 in step S110, the CPU 201 determines that the sheet 1 is in the buckled state (the jam state) and causes the process to proceed to step S115. Then, after stopping the rotation of the roll R, the process proceeds to step S116, and the CPU 201 executes a predetermined error process. Specifically, the CPU 201 displays information indicating that the leading end of the sheet 1 is unable to be normally set, and a feeding error occurs, on a display of a manipulation panel to urge the user to check the sheet 1.

On the other hand, when the output value V does not satisfy T1<V<T2 in step S110, the CPU 201 causes the process to proceed to step S111, and determines whether or not the sheet 1 becomes the bellows state such as the solid line 1C illustrated in FIG. 8C using threshold values T3 and T4 different from the threshold values T1 and T2.

When the sheet 1 moves in the bellows state such as the solid line 1C, the optical sensor 60 and the sheet 1 get closer to each other or are separated from each other repeatedly. Therefore, in the present embodiment, a lower limit threshold value T3 for determining that they are separated from each other and an upper limit threshold value T4 for determining that they get closer to each other are prepared, and in a case in which it fluctuates between them a predetermined number of times (Tn), the CPU 201 determines that the sheet 1 is in the bellows state. In this case, the lower limit threshold value T3 is preferably set to a larger value than the upper limit threshold value T2 for discriminating the buckled state described above, and here, the threshold values T3 and T4 are set in accordance with the following Formulas.

$$T3=(Fv+Nv)\times0.2$$

$$T4=(Fv+Nv)\times0.4$$

The description returns to the flowchart of FIG. 10. In step S111, the CPU 201 determines whether or not the sensor output value V satisfies T3>V. In a case where T3>V is not satisfied, CPU 201 regards that no sheet jam occurs in the current state, causes the process to return to step S109 and continuously detects the sensor output. On the other hand, in a case where the sensor output value V satisfies T3>V, the CPU 201 causes the process to proceed to step S112.

In step S112, the CPU 201 determines whether or not the counter N exceeds a predetermined count threshold value Tn. In a case where the counter N does not exceed a predetermined count threshold value Tn, the process proceeds to step S113, the CPU 201 is on standby for the rotation of the roll R by a predetermined rotational angle and then determines whether or not it is a state in which the output value V satisfies T4<V. In a case where the output value V satisfies T4<V, the CPU 201 regards that one mountain valley in the bellows (that is, the state of T3>V and the state of T4<V) is confirmed, causes the process to proceed to S114, and increments the counter N. Then, the CPU 201 causes the process to return to step S109 and continuously detects the sensor output. On the other hand, in a case where the output value V does not satisfy T4<V, the CPU 201 causes the process to return to step S109 without change and continuously detects the sensor output.

When it is determined in step S112 that the counter N exceeds the counter threshold value Tn, the CPU 201 determines that the sheet 1 is in the bellows state (the jam state). Accordingly, the CPU 201 causes the process to proceed to step S115, stops the rotation of the roll R, and then executes a predetermined error process. Thereafter, in step S117, the CPU 201 stops the output detection of the optical sensor 60. Thereafter, the present process ends.

According to the present embodiment described above, it is possible to perform the detection of the leading end of the roll sheet R and the checking of the sheet supply state after the leading end is detected on the basis of the output value of the optical sensor 60 installed in the arm member 4. In other words, it is possible to detect the sheet jam early and solve the sheet jam in the sheet leading end setting process before the sheet 1 is guided into the sheet conveying unit 300 or the conveying roller 14 is driven.

In the above example, the method of setting the threshold values T1 to T4 is described by using Formulas, but the method of setting the threshold values is not limited to the above-described method. Further, even when the same optical sensor is used, the reflectance of the sheet changes depending on a type of sheet, and Fv and Nv also change depending on a type of sheet accordingly. Further, the distance between the sensor and the sheet suitable for determining buckled state and the number of mountain valleys suitable for determining the bellows state also differ depending on the stiffness of the sheet. In other words, the threshold values T1 to T4 and the counter threshold value Tn are preferably optimized individually for each type of sheet which can be loaded into the apparatus.

In the above example, the optical sensor 60 including the light emitting unit 6*c* and the light receiving unit 6*d* is employed as the configuration of the sensor unit 6, but the present invention is not limited thereto. For example, the light detected by the light receiving unit 6*d* may not be regular reflection light. A sensor of any configuration can be used as long as it is a sensor whose output value changes in accordance with the distance to the sheet 1 serving as the detection target. For example, a distance sensor such as an ultrasonic sensor or an electrostatic sensor that detects the distance to the object in a non-contact manner can be used.

Further, in the above example, the detection of the sheet leading end F and the determination of the sheet jam are performed on the basis of the output value V of one sensor, but the present invention is not limited to such a form. In the sheet sensor unit 6, a plurality of sensors may be arranged in the X direction or the Y direction. In this case, when the detection of the sheet leading end F and the determination of the sheet jam are performed using output values of a plurality of sensors, it is possible to perform the detection of the sheet leading end F and the determination of the sheet jam further reliably.

In the above example, the printing apparatus 100 in which the two roll sheets can be set have been described as an example, but it may be in a form in which one roll sheet can be set, or it may be a form in which three or more roll sheets can be set. Further, the present invention is not limited to the roll sheet, and it is also possible to determine the occurrence of jam while the cut sheet is being conveyed from a change in the output value of the sensor.

The present invention can be widely applied as a supplying apparatus that supplies various sheets including paper, a film, cloth, and the like, a printing apparatus including the supplying apparatus, and various sheet processing apparatuses such as an image scanning apparatus. The image scanning apparatus scans an image of a sheet supplied from the supplying apparatus through a scanning head. Further, the sheet processing apparatus is not limited to only the printing apparatus and the image scanning apparatus as long as various processes (processing, coating, irradiation, inspection, and the like) can be performed on the sheet supplied from the supplying apparatus. In a case in which the sheet supplying apparatus is configured as an independent apparatus, the apparatus can be equipped with a control unit including a CPU. In a case in which the sheet supplying apparatus is installed in the sheet processing apparatus, at least one of the supplying apparatus and the sheet processing apparatus can be equipped with a control unit including a CPU.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-046416 filed Mar. 10, 2017, which is hereby incorporated by reference herein in its entirety.

What is claimed is:

1. A printing apparatus comprising:

a holding unit configured to hold a roll sheet being a continuous sheet wound in a roll form;

a printing unit configured to perform printing on a sheet supplied from the holding unit;

a driving unit configured to perform a conveyance operation to rotate in a first direction to cause the roll sheet held in the holding unit to rotate in a forward direction and convey the sheet to the printing unit;

a first sensor configured to change its output value in accordance with a distance to the sheet of the roll sheet held in the holding unit;

a second sensor located on a conveyance path between the first sensor and the printing unit and configured to detect the sheet during the conveyance operation;

a detecting unit configured to detect a leading end of the sheet on the basis of the output value of the first sensor while causing the roll sheet to rotate in a reverse direction by causing the driving unit to rotate in a second direction opposite to the first direction a control unit configured to switch a rotation direction of the driving unit from the second direction to the first direction after the detecting unit detects the leading end of the sheet; and a determining unit configured to determine a conveying state of the conveyed sheet, before the second sensor detects the sheet, on the basis of fluctuation of the output value of the first sensor while the driving unit rotates in the first direction.

2. The printing apparatus according to claim 1, wherein the first sensor is an optical sensor whose output value increases as a distance to the sheet decreases, and which is installed in a guide for guiding the sheet separated from the roll sheet.

3. The printing apparatus according to claim 2, wherein, in a case in which the output value of the first sensor is less than a first threshold value which is less than a first output value obtained when the sheet abuts on the guide, the determining unit determines that the conveying state has an error.

4. The printing apparatus according to claim 3, wherein the first threshold value is a value between the first output value and a second output value of the first sensor obtained when the leading end of the sheet is not separated from an outer circumferential surface of the roll sheet.

5. The printing apparatus according to claim 3, wherein, in a case in which the output value of the first sensor increases and decreases between a second threshold value greater than the first threshold value and a third threshold greater than the first threshold value a predetermined number of times, the determining unit determines that the conveying state has an error.

6. The printing apparatus according to claim 1, wherein the detecting unit detects the leading end of the sheet on the basis of a change in the output value of the first sensor when the leading end of the sheet separated from an outer circumferential surface of the roll sheet passes through a detection position of the first sensor while causing the roll sheet to rotate in the forward direction.

7. The printing apparatus according to claim 1, wherein the driving unit is stopped in a case where the determining unit determines that the conveying state has an error.

* * * * *